US005569130A

United States Patent [19]

Wang et al.

[11] Patent Number: 5,569,130

[45] Date of Patent: Oct. 29, 1996

[54] ROWING MACHINE

[75] Inventors: Leao Wang; Peter Wu, both of Taichung Hsien, Taiwan

[73] Assignee: Greenmaster Industrial Corp., Taichung Hsien, Taiwan

[21] Appl. No.: 525,018

[22] Filed: Sep. 8, 1995

[51] Int. Cl.[6] ..... A63B 69/05

[52] U.S. Cl. ..... 482/96; 482/95; 482/72; 482/51

[58] Field of Search ..... 482/95, 130, 96, 482/137, 57, 71, 72, 51, 111, 148; 472/106, 110

[56] References Cited

U.S. PATENT DOCUMENTS 4,743,010 5/1988 Geraci ..... 482/95
5,342,269 8/1994 Huang et al. ..... 482/95
5,356,358 10/1994 Chen ..... 482/72
5,458,553 10/1995 Wu ..... 482/95

*Primary Examiner*—Jerome Donnelly
*Attorney, Agent, or Firm*—Bacon & Thomas

[57] ABSTRACT

An improved rowing machine includes two main frames, a rear horizontal tube, two rowing bars, a link, a support bar and an action column. A user may ride on a slidable seat of the action column with both feet placed against two pedals at both sides of a front end portion thereof, with both hands pulling the rowing bars. The link drives the support bar to elevate the action column to move on its pivot, so actual rowing may be imitated to achieve exercising effects. As the pivot of the action column is located near the user's side, the slanting angle of the action column when elevated may be reduced to ensure safety. When pressed against by the user's feet, the pedals will provide an auxiliary lifting force according to the lever principle, this facilitating the user's application of force at the rowing bars.

4 Claims, 7 Drawing Sheets

ROWING MACHINE

BACKGROUND OF THE INVENTION (a) Field of the Invention

The present invention relates generally to a rowing machine, and more particularly to a rowing machine in which a pivot of an action column is located near to the user's side for reducing the slanting angle of the action column when lifted, ensuring safety during use, and in which pedals provided on both sides of a front end portion of the action column provide an auxiliary elevating force when pressed against by the user's feet for facilitating the user's application of force on the rowing bars.

(b) Description of the Prior Art

FIG. 1 shows a conventional rowing machine, essentially comprising a base 10, and a seat plate 12 located above the base 10 and pivotally connected to a front end thereof. A bottom end of a middle section of the seat plate 12 is connected to one end of a support bar 14 with a pulley. The other end of the support bar 14 is pivotally connected to the base 10 at a suitable position. The support bar 14 is further connected to a couple of rowing bars 16. When the rowing bars 16 are operated, the support bar 14 will, due to linking-up movement, lift up the seat plate 12 by means of the displacement of its pulley. However, since the seat plate 12 and the base 10 share a common fulcrum A at their joint at the front end thereof, when the seat plate 12 is tilted relative to the fulcrum A, a seat 11 on the seat plate 12 will be at a comparatively high position from the floor and is in an inclined state. (Under the same internal angle, the distance from a point on the seat plate 12 nearer to the fulcrum A to a reference plane is smaller than the distance from another point on the seat plate 12 farther to the fulcrum A to the reference plane.) The user sitting on the seat 11 will also incline substantially forward so that his/her weight is concentrated at the front end of the base 10. There is a great possibility that the user may fall down accidentally. Furthermore, in such a conventional rowing machine, only a single support bar is employed to work in cooperation with the rowing bars 16 for supporting the user's weight, without any auxiliary or supplementary support to facilitate the application of force on the rowing bars in working the rowing machine. To overweight people, or those of not very good physique or having poor cardiac or pneumonic functions, such rowing machines are not suitable.

FIG. 2 shows another conventional rowing machine which was later developed. It essentially comprises a couple of rowing bars 20 horizontally provided with a post 21, which is in turn pivotally provided with a roller 22 at a center thereof. When the rowing bars 20 are operated, the post 21 will be brought to displace upwardly, and the roller 22 will lift up a seat plate 23. At this time, since the seat plate 23 is pivotally connected to four linking-up levers 24, the seat plate 23 is elevated or lowered in a horizontal manner.

Although such a conventional rowing machine provides a certain degree of safety, it is arranged to have four linking-up levers 24 for supporting the seat plate 23 so that the application of force by the user is greatly reduced, which may undermine or even obviate the exercising effects. A damping element 25 is therefore provided below the post 21 to provide a damping force to enhance the exercising effects. This conventional rowing machine is therefore complicated in construction and expensive to manufacture.

In addition, since the seat plate 23 is elevated or lowered in a horizontal manner, when the user pulls the rowing bars 20 backwardly to the highest point, he/she will also rise with the seat plate 23. At this time, the user's hands are however located on both sides of his/her hip. But as a matter of fact, in actual rowing, the rower holds the oars and move them upwardly and then downwardly and backwardly so as to drive the oars into the water to push a rowing boat forward. In brief, when the user is performing a back pulling action, his/her hands should move from the height of the legs gradually to the height of the chest. However, in this conventional rowing machine, the direction of rowing actions is just opposite, which is a serious error in the design.

SUMMARY OF THE INVENTION

A primary object of the present invention is to provide a rowing machine which not only is safe to manipulate but also may simulate actual rowing.

Another object of the present invention is to provide a rowing machine of a simpler construction than the conventional ones, in which pedals are provided to faciliate the application of force on the rowing bars based on the lever principle, so that all the four limbs may be exercised, without the need to provide a damping element as in the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
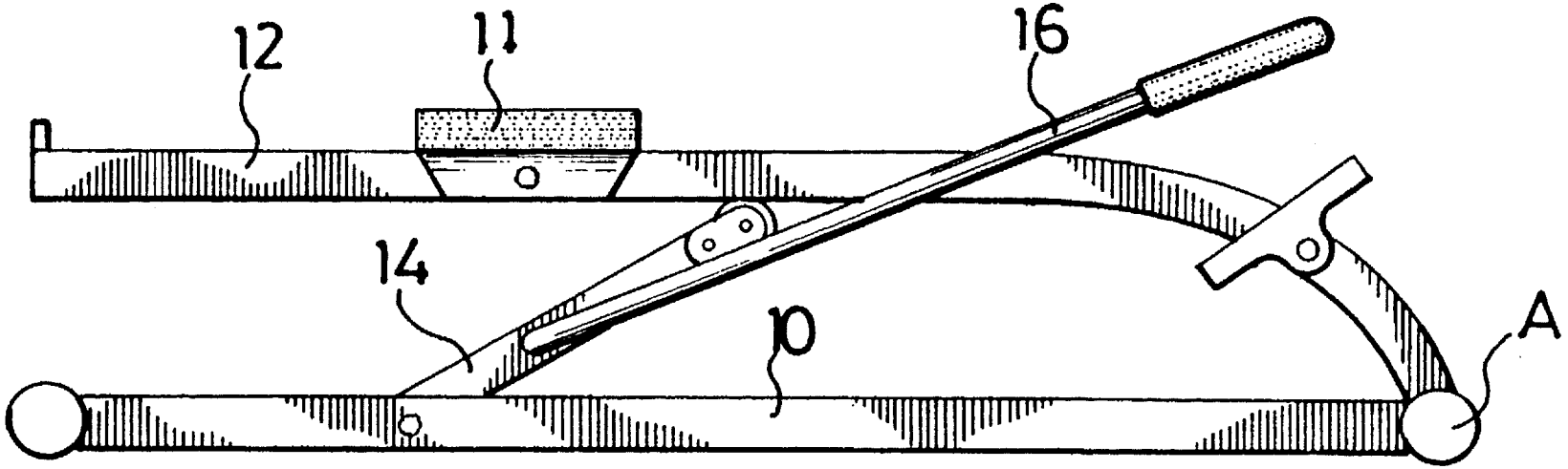
PRIOR ART FIG.1
FIG. 1 is a side view of a first conventional rowing machine.
Figure 2:
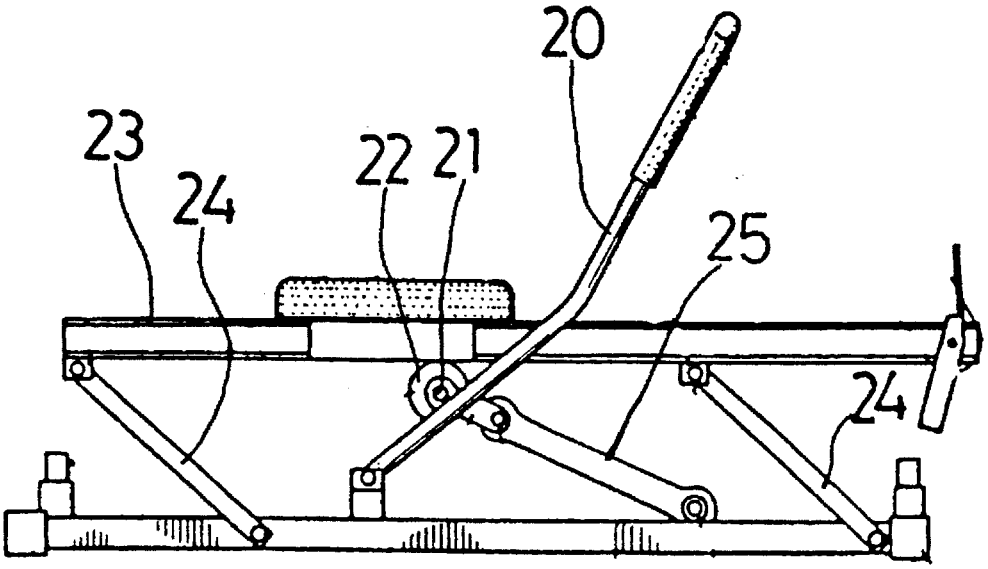
PRIOR ART FIG.2
FIG. 2 is a side view of a second conventional rowing 25 machine.
Figure 3:
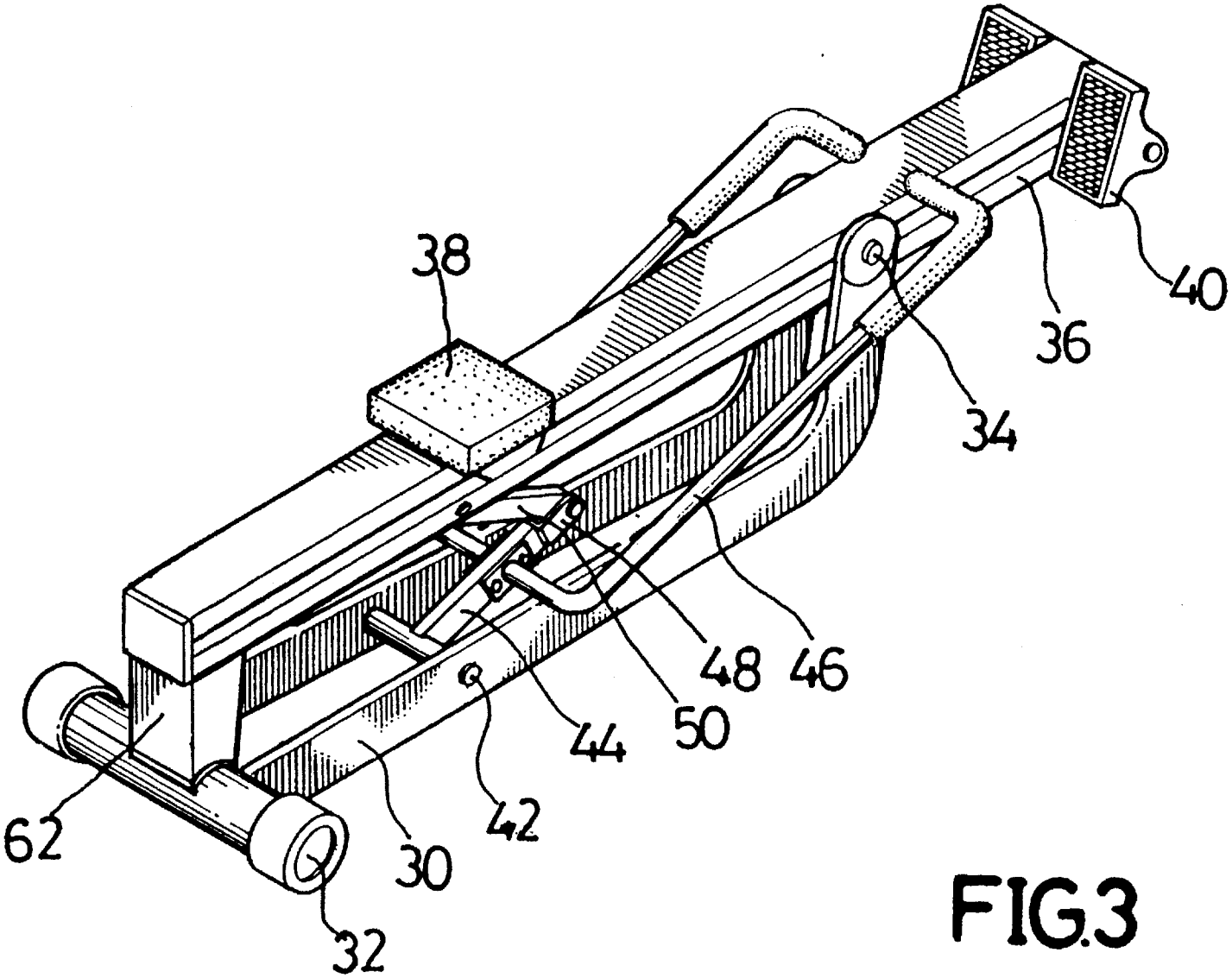
FIG. 3 is a perspective view of the rowing machine according to the present invention in an assembled state.
Figure 4:
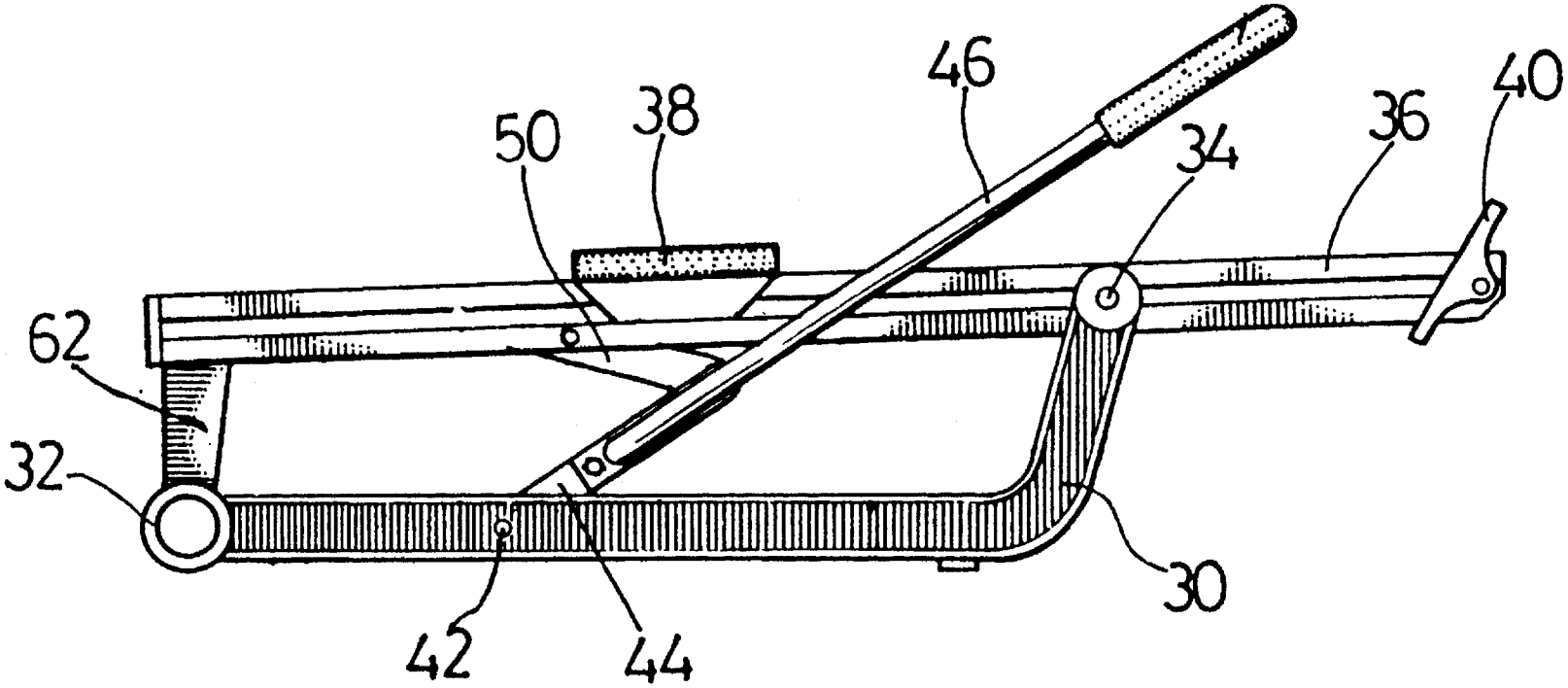
FIG. 4 is a perspective schematic view showing one part of the rowing machine according to the present invention.

With reference to FIGS. 3 and 4, the rowing machine according to the present invention essentially comprises two parallel main frames 30 each of which has a section that extends substantially vertically from a straight section adapted to rest on a support surface, such as a floor, a rear horizontal tube 32 welded to and extending between the rear ends of the main frames 30 and an action column 36 pivotally secured between the main frames 30 by means of a pivot 34. The action column 36 has a pair of lateral sides, with each side including an elongated groove, a seat 38 slidable within the grooves, and a pair of pedals 40 on both sides of a front end portion thereof.

Figure 5:
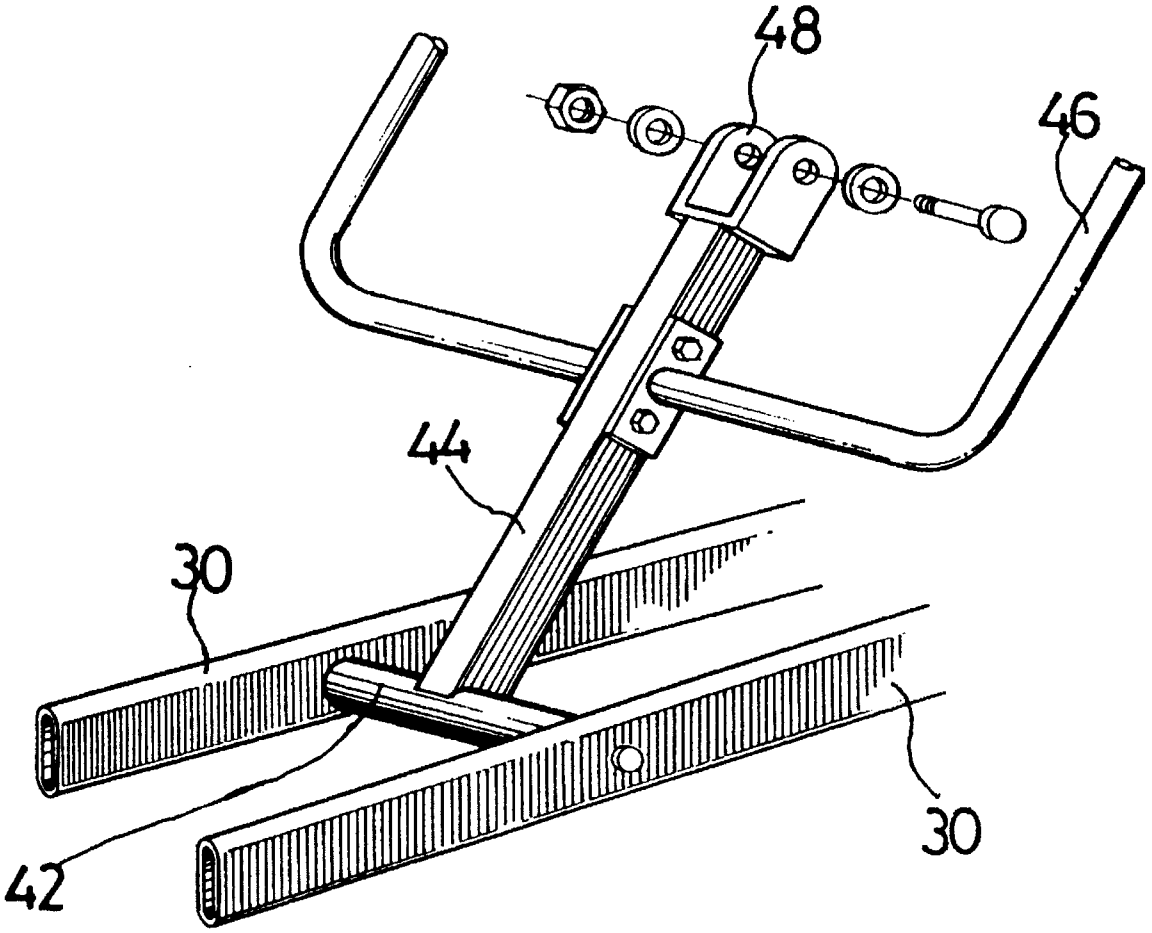
FIG. 5 is a perspective schematic view showing another part of the rowing machine according to the present invention.

With reference to FIG. 5, a tube 42 is pivotally connected to the straight sections of the main frames 30. The tube 42 has a middle section welded to an end of a link 44 an at a right angle with respect to link 44. Two rowing bars 46 are rigidly secured to both sides of the link 44 by means of locking means at suitable positions. In addition, a top end of the link 44 has a U-shaped positioning piece 48 for receiving one end of a support bar 50 with a connecting hole 52 and securing thereto by means of a bolt, washers, and a nut.

Figure 6:
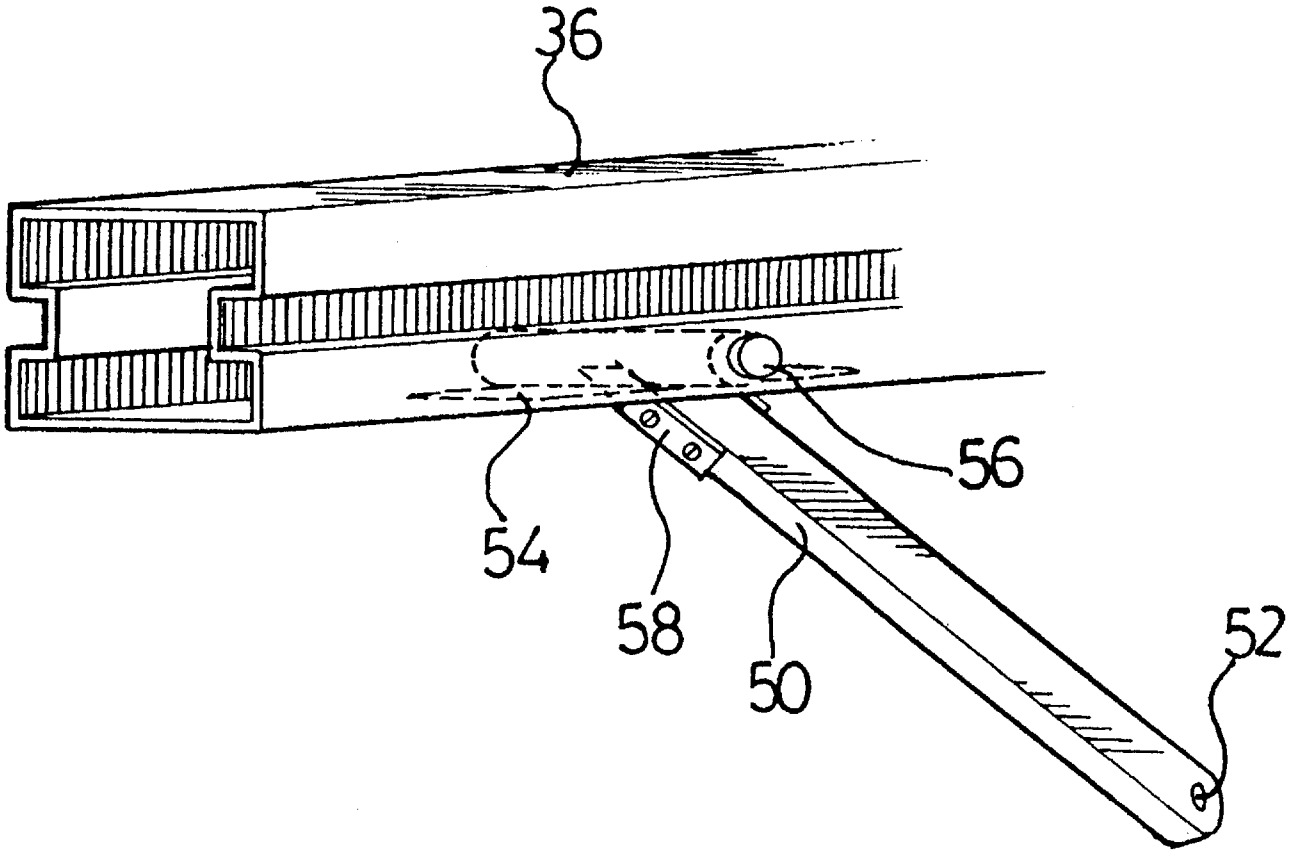
FIG. 6 is a partial side perspective view of the rowing machine according to the present invention in an assembled state.
Figure 7:
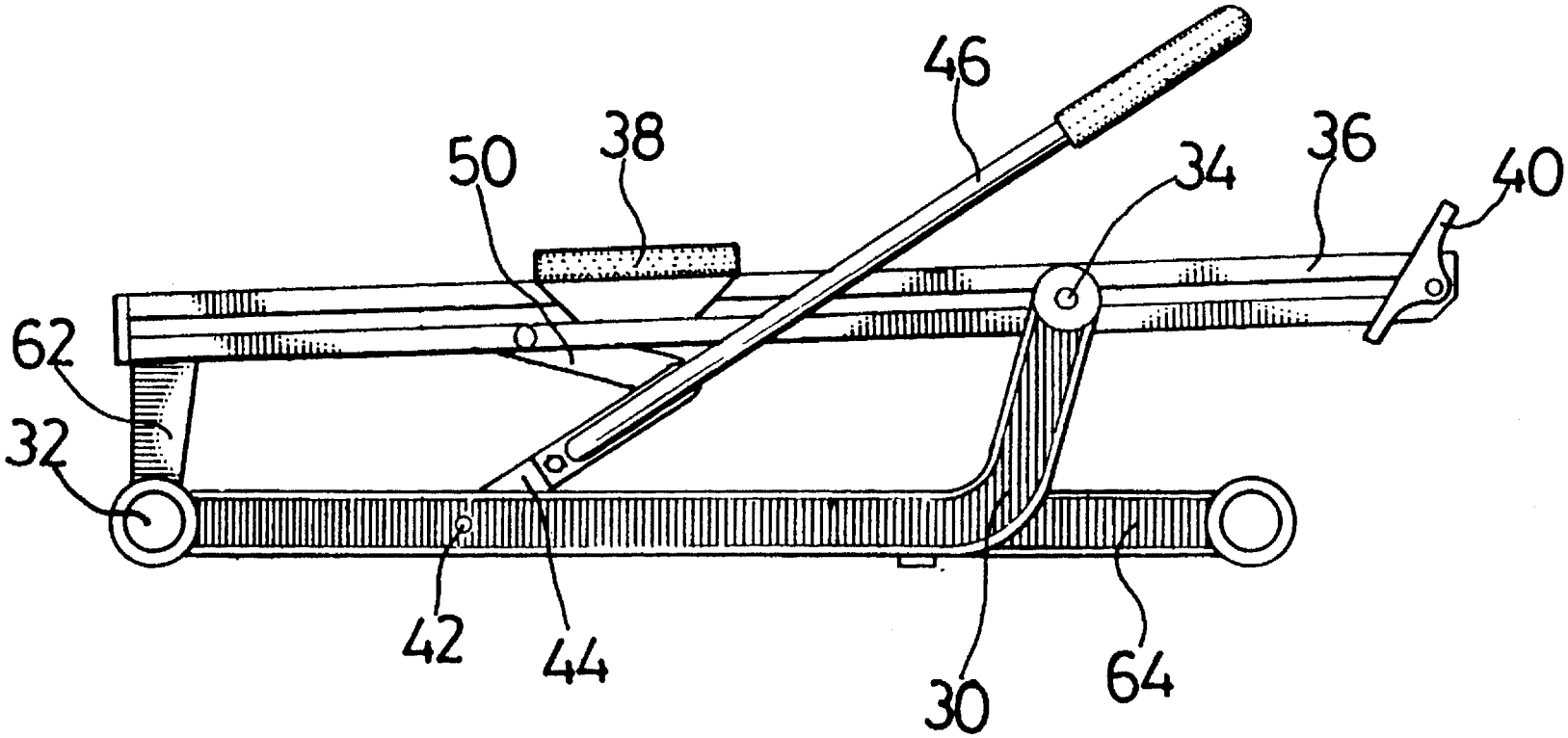
FIG. 7 is a side view of a preferred embodiment of the rowing machine according to the present invention in an assembled state.

Referring to FIG. 6, a top end of the support bar 50 is configured in a cylindrical shape for insertion into a notch 54 formed in a bottom end of the action column 36 and retained therein, the support bar 50 being positioned by means of a pivot 56 which prevents both lateral sides of the support bar 50 from violent rubbing with the notch 54 when the support bar 50 is in action. Rubber pads 58 are further provided at suitable positions on the two lateral sides of the support bar 50.

By means of the above arrangement, the user may sit on the slidable seat 38 on the action column 36 with both legs placed on the pedals 40 on either sides of the front end portion of the action column 36, and the hands pulling the rowing bars 46. The link 44 is caused to drive the support bar 50 to tilt the action column 36 on the pivot, simulating actual rowing movements and achieving the desired exercising effects. Furthermore, as the pivot 34 of the action column 36 is situated nearer to the user, the slanting angle of the action column 36 may be reduced to ensure safety. At the same time, the pedals 34 at the other end of the pivot 40 of the action column 36 may, when pressed against by the user's feet, generate an auxiliary elevating force according to the lever principle and facilitate the user's application of force at the rowing bars. Thus, the rowing machine of the present invention is safe, comfortable and smooth to manipulate.

Additionally, a baffle post 62 is disposed at a rear bottom end of the action column 36 for engaging the rear horizontal tube 32 and restrict the downward travel of the action column 36.

In order to ensure the absolute stability of the rowing machine of the invention, a further support bar 64 may be connected to the front ends of the main frames 30 for firmly supporting them on the floor.

Although the present invention has been illustrated and described with reference to the preferred embodiment thereof, it should be understood that it is in no way limited to the details of such embodiment but is capable of numerous modifications within the scope of the appended claims.

What is claimed is:

1. A rowing machine comprising:

a) two parallel main frames, each main frame including a straight section for engaging a support surface, the straight section having a front portion, a rear end, and a front section extending substantially vertically from the front portion;

b) a first tube secured to and extending between the rear ends of the straight sections of the main frames;

c) an action column including a front end, a rear end and a bottom notch, the front end of the action column being pivotally attached between the front sections of the main frames at the tops thereof, the action column further including a pair of lateral sides, each lateral side having an elongated groove, a seat slidably engaged within the grooves and a pair of pedals mounted at the front end of the action column on opposite sides thereof;

d) a second tube pivotally connected to and extending between the straight portions of the main frame, the second tube including a middle section;

e) a link including a first end and a second end, the first end of the link being pivotally secured to the middle section of the second tube to dispose the link at a right angle with respect to the second tube, the second end of the link including a U-shaped positioning piece;

f) a pair of rowing bars rigidly secured to opposite sides of the link;

g) a support bar including a first end and a second end, the first end of the support bar being pivotally secured to the U-shaped positioning piece and the second end of the support bar being configured in a cylindrical-shaped body pivotally secured within the bottom notch of the action column so that the link extends forwardly from the second tube towards the from end of the action column and the support bar extends rearwardly from the positioning piece towards the bottom notch of the action column; and h) whereby when the feet of the user are pressed against the pedals and the user pulls the rowing bars upwardly and rearwardly, the pivotal movements of the link and the support bar with respect to the main frames and the action column causes the rear end of the action column to be raised, thus pivoting the action column at the pivot connection between the main frames to simulate a rowing motion.

2. The rowing machine of claim 1 further including a baffle post extending upwardly from the first tube for limiting the downward movement of the action column.

3. The rowing machine of claim 1 wherein the first end of the link is welded to the middle section of the second tube.

4. The rowing machine of claim 1 further including a plurality of rubber pads disposed on opposite sides of the cylindrical-shaped body for cushioning same.

* * * * *